US005202695A

United States Patent [19]

Hollandsworth et al.

[11] Patent Number: 5,202,695

[45] Date of Patent: Apr. 13, 1993

[54] ORIENTATION STABILIZATION BY SOFTWARE SIMULATED STABILIZED PLATFORM

[75] Inventors: Paul E. Hollandsworth, Charlottesville; Clifford Cantrell, North Garden, both of Va.

[73] Assignee: Sperry Marine Inc., Charlottesville, Va.

[21] Appl. No.: 589,122

[22] Filed: Sep. 27, 1990

[51] Int. Cl.[5] ..... H01Q 3/00

[52] U.S. Cl. ..... 342/359; 318/649; 244/3.16; 89/41.09

[58] Field of Search ..... 342/359; 359/554; 318/649; 244/3.16, 3.19; 89/41.09

[56] References Cited

U.S. PATENT DOCUMENTS 3,401,599 9/1968 Schonherr et al. ..... 89/41
4,179,696 12/1979 Quesinberry et al. .
4,393,597 7/1983 Picard et al. ..... 33/275
4,621,266 11/1986 Le Gall et al. ..... 342/359

*Primary Examiner*—Theodore M. Blum

*Attorney, Agent, or Firm*—Seymour Levine; Albert B. Cooper

[57] ABSTRACT

The line of sight of an airborne radar antenna is stabilized from the pitch and roll motions of the aircraft by mounting the antenna on a three degree of freedom gimbal system. The gimbal system is comprised of a first gimbal mounted for rotation about the aircraft Z axis (azimuth) for pointing the antenna along the intended line of sight, a second gimbal mounted on the first gimbal for rotating up and down with respect to the azimuth gimbal and a third gimbal mounted on the second gimbal to which the antenna is connected for providing rotation to align antenna polarization relative to inertial ground. A two degree of freedom stabilization gyro provides stabilizing signals representative of aircraft pitch and roll motions with respect to inertial reference axes. The stabilization signals, together with a line of sight pointing signal, are applied to coordinate transformation equations to generate drive signals for the respective gimbals so as to maintain the antenna pointing in the intended direction with correct polarization.

17 Claims, 3 Drawing Sheets

ORIENTATION STABILIZATION BY SOFTWARE SIMULATED STABILIZED PLATFORM

BACKGROUND OF THE INVENTION

1. Field of the Invention

The invention relates to stabilized platforms that maintain a fixed orientation with respect to inertial axes for use on moving vehicles.

2. Description of the Prior Art

Mechanically gimballed stabilized platforms are known in the prior art for maintaining a fixed orientation with respect to inertial axes. Such platforms are stabilized by a stabilization data source, such as one or more gyros and generally stabilize pointing devices or systems used aboard moving vehicles such as ground vehicles, aircraft, marine vessels and space craft from the movement of the vehicle. Such pointing systems include radar antennas, optical sights, cameras, satellite antennas, and the like. Isolation of the movement of the vehicle from the pointing device is required, since the movement would result in errors in the line of sight of the device, creating blurring or even rendering the device inoperative. For example, in an airborne, ground mapping radar, the motion of the aircraft tends to blur the ground targets and to lower the perceived resolution of the radar picture. The vehicle motion would also cause the targets to appear at different locations from sweep to sweep, making identification of targets difficult. Thus, stabilized platforms are utilized on moving vehicles such that the motion of the vehicle does not interfere with the gathering of data by a pointing device. The pointing device is generally moved relative to the stabilized platform to point at targets.

Traditionally, stabilization is accomplished utilizing a mechanical gimbal system that is separate and in addition to the gimbals that move the pointing device relative to the platform. The platform gimbal system duplicates the gimbal arrangement of the stabilization data source, such as a gyro. Typically, a mechanically stabilized platform has two stabilization axes with a third axis for rotating the pointing device relative to the platform. The pointing device itself may require two axes relative to the platform, one for azimuth and the other for elevation, thus unduly increasing the total number of gimbals required for the system and decreasing overall system reliability.

With the prior art mechanically gimballed platform, the order of precession of the gimbals in the stabilization gyro dictates the order of precession of the axes of the platform. This is because a gimbal is always referenced to the gimbal in which it is mounted. For example, in a two axis system where the gyro gimbals are arranged as pitch inside of roll, the stable platform gimbals must be constructed with pitch inside of roll. If a third axis is desired for rotation of a pointing device with respect to the platform, the rotation of the third axis must follow in the precession order of the platform axes. This limitation results in non-optimum system designs. In the example of the airborne, ground mapping radar system, the precessional order of the axes results in the antenna hanging down on a lever arm mounted to the platform and sweeping over a large volume relative to the aircraft as the antenna rotates and the aircraft rolls and pitches. Generally this is undesirable, since the large swept volume required for the moving antenna conflicts with space limitations normally associated with aircraft.

The large antennas required in narrow beam, high resolution radar systems further exacerbate the problem.

In order to overcome the above-described limitation, the prior art utilizes push/pull linkages or rods with mechanical gearing, or other mechanical linkages, to translate the motion of one axis through the others. For example, in a radar system, the azimuth sweep of the antenna may be translated through the roll and pitch axes by push rods to provide the appropriate rotary motion of the antenna on the stable platform. Although the gimbals are arranged in the order of azimuth, roll and pitch, the linkages cause the antenna pedestal to behave as though the gimbals were arranged in a different order. Thus, in such systems, the push/pull linkages effectively allow the pedestal to perform the stabilization of the antenna as if the gimbals were arranged in the order of roll, pitch, and then azimuth. Mechanical linkages suffer from low reliability, difficulty in assembly, and wearout of the mechanisms. Although these mechanical gear and linkage arrangements reduce the swept volume of the antenna and provide proper stabilization, component wear over time tends to decrease the overall system reliability.

Thus, traditional antenna pedestal systems utilize a two-axis stabilized platform about which the spinning or rotational azimuth scan occurs. Not only does this result in an increase in swept volume of the rotating antenna, but the drive systems usually comprise geared rotational arrangements resulting in poor lifetime reliability. Furthermore, an additional antenna degree of freedom, such as elevation, requires yet another gimbal set thereby increasing complexity and expense and decreasing system reliability.

SUMMARY OF THE INVENTION

The shortcomings of the prior art are obviated by a gimballed system for stabilizing the pointing direction of a pointing device with respect to inertial reference axes using a software simulated stable platform. The pointing device is mounted on a gimbal configuration having sufficient degrees of freedom to point the pointing device in all desired directions. A gimballed stabilization data source stabilized with respect to the inertial reference axes, includes a gimballed system with gimbal precesion order different from that of the gimbal system on which the pointing device is mounted. The system is responsive to a direction control signal in accordance with the desired pointing direction. Stabilization signals from the stabilization data source, along with the direction control signal, are applied through coordinate transformations to control the gimbals on which the pointing device is mounted, so as to maintain the pointing device oriented to point in the desired direction.

DESCRIPTION OF THE PREFERRED EMBODIMENT

Figure 1:
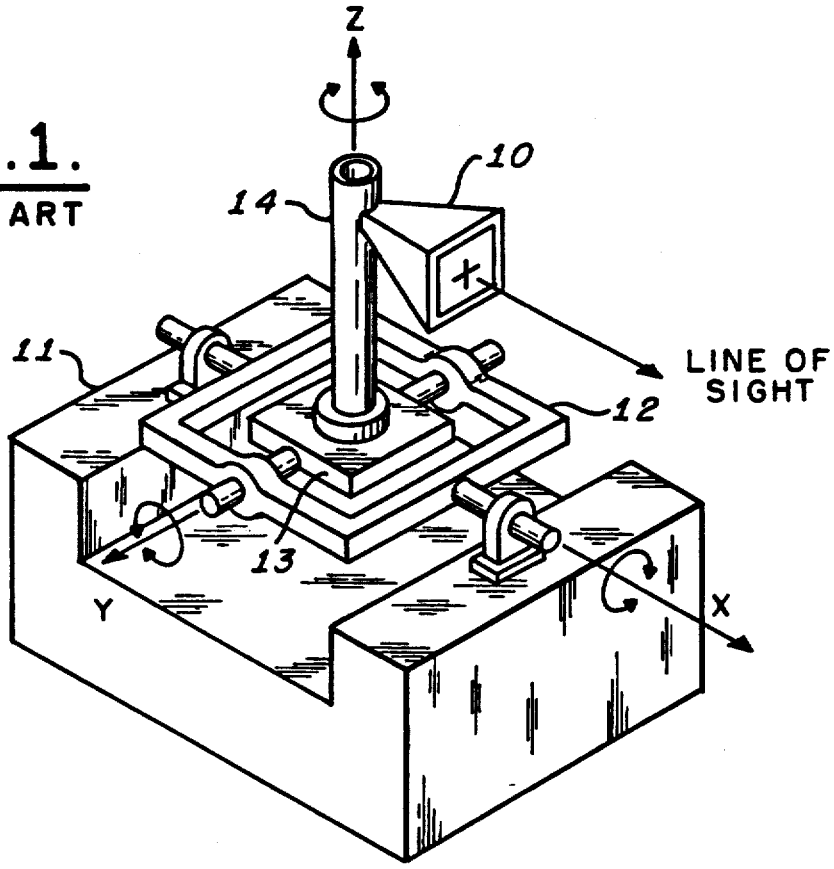
FIG. 1. PRIOR ART
FIG. 1 is a schematic diagram of a mechanically stabilized platform configured in accordance with the prior art for stabilizing the line of sight of a radar antenna.

Referring to FIG. 1, a schematic diagram of a typical two axis, mechanically stabilized platform with a third axis for rotating a pointing device 10, such as a radar antenna, is illustrated. All motions of the antenna 10 are relative to a base 11 which represents the vehicle, such as an aircraft, in which the platform is deployed. A roll gimbal 12 and a pitch gimbal 13, journaled in the roll gimbal 12, provide a mechanically stabilized platform by angular adjustments about axes X and Y. An azimuth gimbal 14 spins about the stabilized Z axis, producing line of sight stabilization. The platform illustrated, utilizes a gimbal order of pitch inside roll. The order of precession of the gimbals is roll (12), pitch (13) and azimuth (14). It is appreciated, that the stabilization gyro (not shown) for the stabilized platform of FIG. 1, must also have a gimbal configuration of pitch inside roll where the order of precession of the axes is roll followed by pitch.

Although the antenna 10 is illustrated as a horn for simplicity, it is appreciated that typically an oval shaped dish antenna is utilized with the base of the antenna fixed to the azimuth gimbal 14 at the attachment point illustrated for the horn antenna 10. Since the roll and pitch axes converge at the edge of such an antenna, the antenna will execute a large swept volume as the aircraft rolls and pitches and the antenna rotates in azimuth. In other words, the lever arm represented by the shaft 14 from the platform to the antenna mounting point causes the antenna 10 to sweep out the large volume.

Furthermore, if antenna elevation control is required, an elevation gimbal would be interposed between the azimuth gimbal 14 and the antenna 10 adding further complexity and expense to the system.

The present invention may be utilized in any application that requires a stabilized platform, such as cameras, lenses, lasers and radars. The present invention will be described herein with respect to a two axis stabilized, fully rotational radar antenna pedestal.

Figure 2:
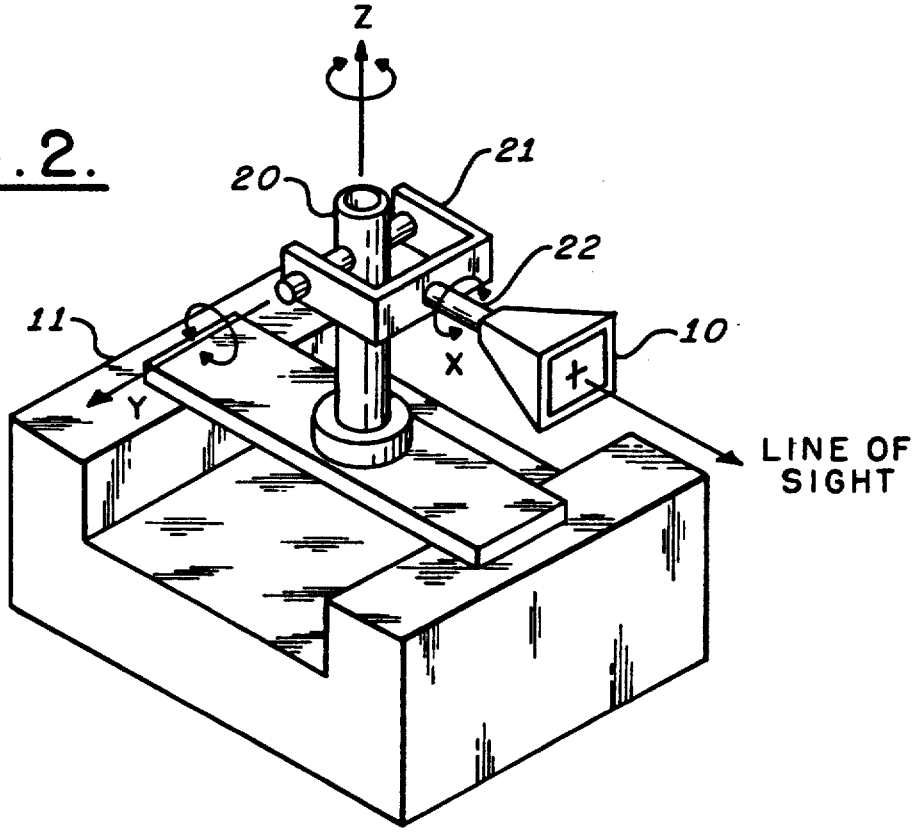
FIG. 2 is a schematic diagram of a software stabilized platform in accordance with the present invention for stabilizing the line of sight of a radar antenna.

Referring to FIG. 2, the gimbal portion of the software stabilized platform, in accordance with the present invention, is illustrated. In a manner similar to that described above with respect to FIG. 1, all motions are relative to the base 11, representing the vehicle in which the platform is mounted. The gimbals, however, are differently named, have a different order of precedence and rotate relative to a different plane with respect to that illustrated in FIG. 1. A gimbal 20 rotates about the gimbal azimuth Z axis. The gimbal azimuth gimbal 20 is different from the aircraft azimuth gimbal 14 illustrated in FIG. 1. A gimbal 21 journaled in the rotating azimuth shaft 20 rotates about the gimbal pitch Y axis. The gimbal pitch gimbal 21 rotates up and down from the rotating azimuth shaft 20 to point the antenna 10 along the intended line of sight. The gimbal pitch gimbal 21 is different from the aircraft pitch gimbal 13 illustrated in FIG. 1. A gimbal 22 journaled in the gimbal pitch gimbal 21, rotates about the gimbal twist X axis. The gimbal twist gimbal 22 turns to correct the polarization of the antenna 10 relative to inertial ground. The gimbal twist gimbal 22 is different from the aircraft roll gimbal 12 illustrated in FIG. 1. It is appreciated, that drive motors and position feedback elements (not shown in FIG. 2) are appropriately installed to provide the described rotations. As shown in FIG. 2 the center (line of sight) of the antenna 10 is coincident with the gimbal twist X axis. If should be apparent, however, that this is not limitative and that the antenna 10 may be mounted on the gimbal twist gimbal 22 with the center line of the antenna 10 in a parallel alignment with the gimbal twist axis X. It should also be apparent that the center line remains parallel to the gimbal twist axis X irrespective of the three gimbal axes rotations.

Figure 3:
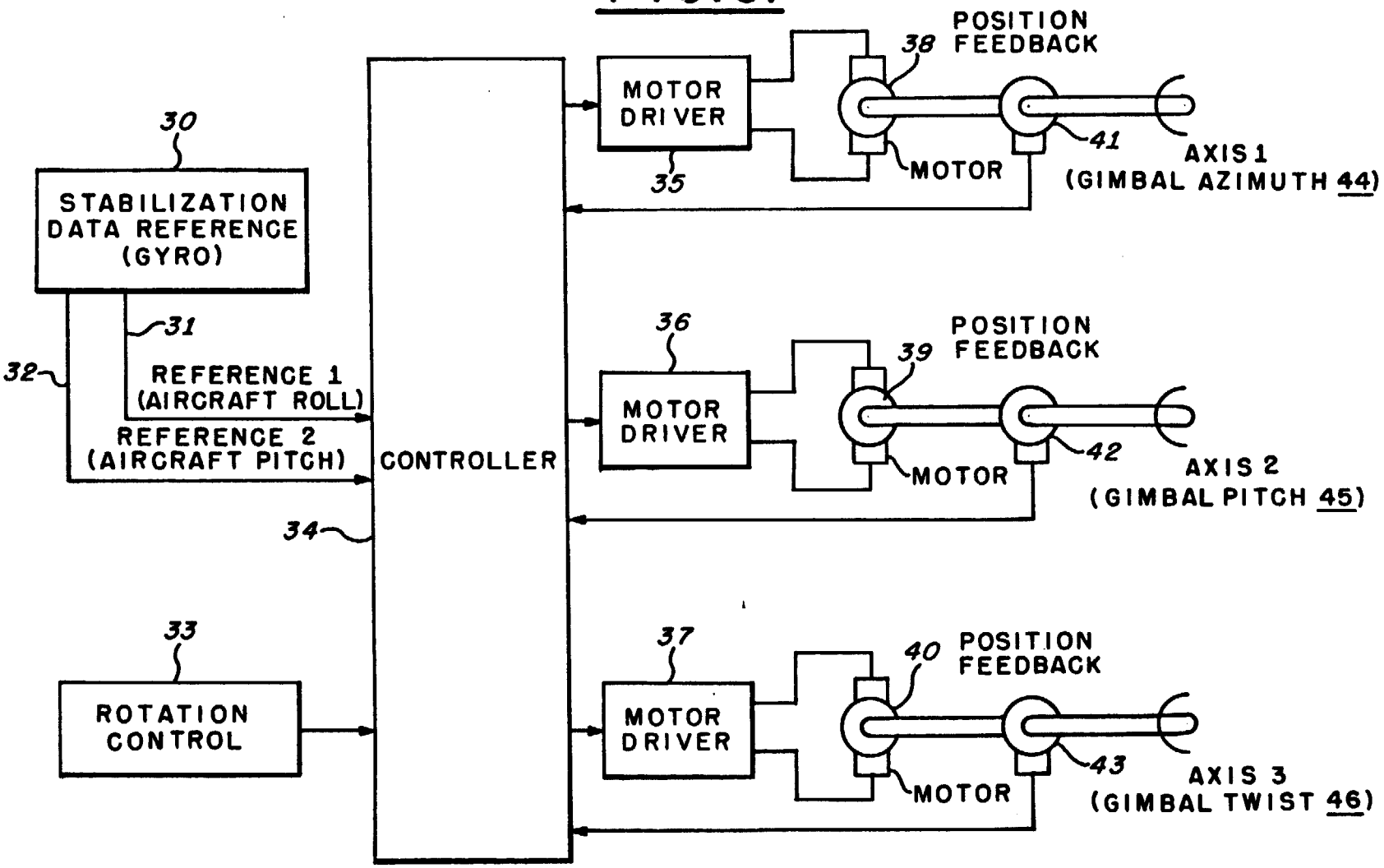
FIG. 3 is a schematic block diagram of the control configuration for the software stabilized platform of FIG. 2.

The software stabilized platform of the present invention includes circuitry for providing the drive signals for the gimbals 20–22 of the platform gimbal system illustrated in FIG. 2. Referring to FIG. 3, stabilization data is obtained from a stabilization data reference 30, which traditionally comprises a gimballed gyro. In the two axis stabilized airborne radar embodiment described herein, the reference 30 comprises a two degree of freedom attitude reference providing stabilization reference signals proportional to aircraft roll and aircraft pitch. The outputs from the reference 30 are denoted as Reference 1 and Reference 2 which are provided to a controller 34. Generically, the reference 30 has as many degrees of freedom and provides a concomitant number of reference signals to the controller 34 in accordance with the degrees of freedom otherwise required for a conventional, mechanically stabilized platform in the same environment. For two axes of stabilization, two reference axes such as roll 31 and pitch 32 are required. A rotation control 33 provides a signal in accordance with the desired line of sight scan of the antenna 10 about the Z axis of FIG. 1.

The attitude reference signals from the stabilization data reference 30 and the rotation control signal from the source 33 are applied to the controller 34. The controller 34 executes a coordinate transformation algorithm to be discussed with respect to FIG. 4. The controller 34 provides three outputs, one for each of the new axes: gimbal azimuth 44, gimbal pitch 45 and gimbal twist 46. The outputs from the controller 34 are applied to motor drivers 35, 36 and 37 for each of the new axes, respectively. The motor drivers 35–37 apply drive signals to respective motors 38, 39 and 40 that rotate the respective axes 44, 45 and 46. Feedback for axis control is provided by respective position feedback sensors 41, 42 and 43 which may, for example, comprise optical encoders or synchros. Appropriate analog-to-digital and digital-to-analog converters (not shown) are included in the controller 34 at the input and output interfaces, respectively.

Figure 4:
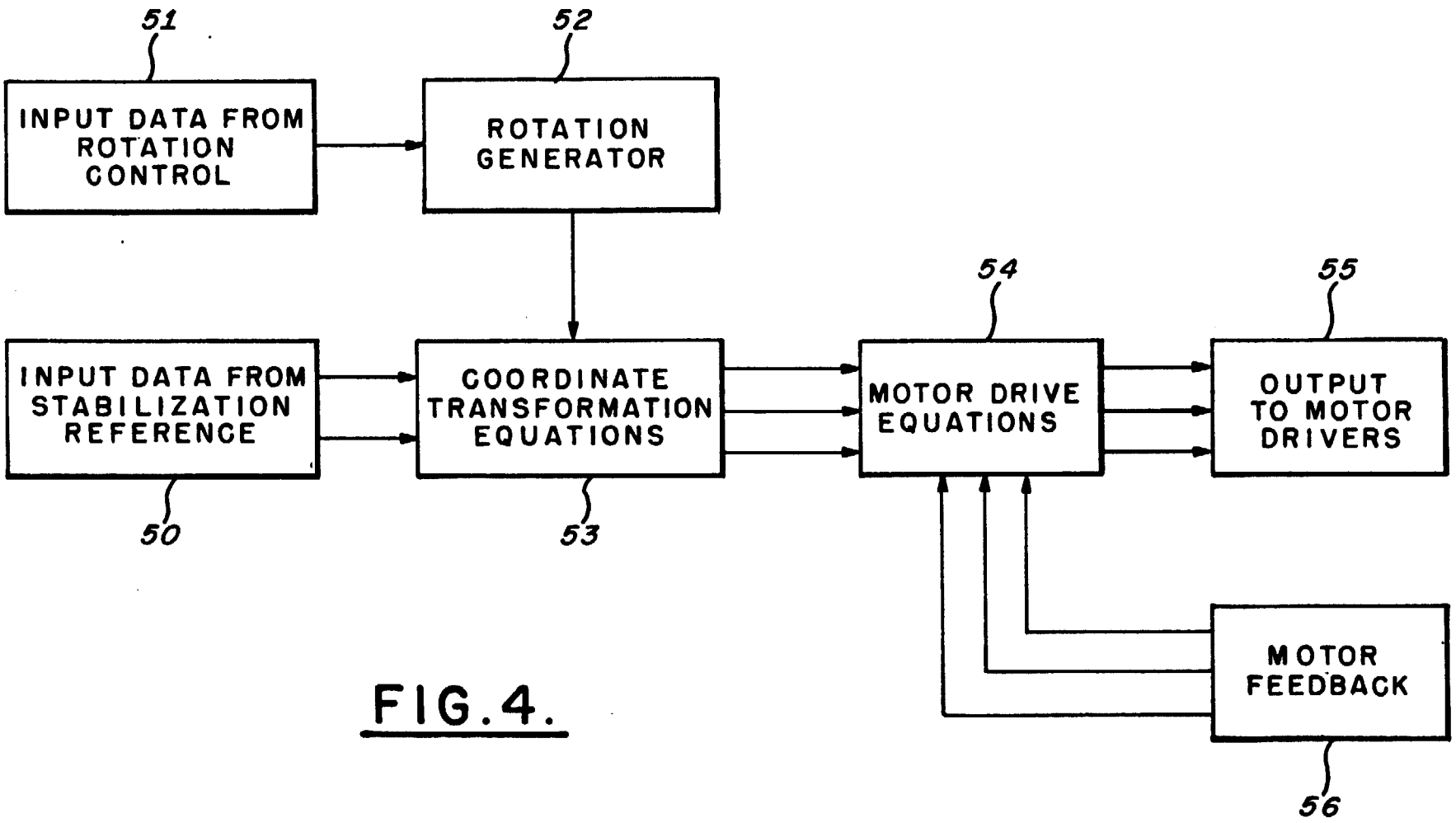
FIG. 4 is a schematic block diagram of the control software for the configuration of FIG. 3.

Referring to FIG. 4, the antenna control software block diagram for the controller 34 is illustrated. Data from the stabilization reference and rotation control data, discussed above with respect to FIG. 3, are input to the software as schematically indicated at 50 and 51. A rotation generator 52 creates the rotation of the antenna with respect to the "stabilized platform". A set of coordinate transformation equations 53 are utilized to convert between the input coordinate system (aircraft roll, aircraft pitch, and antenna rotation) and the output coordinate system (gimbal azimuth, gimbal pitch, and gimbal twist). The coordinate transformation equations 53 create the desired position for each of the new axes. Mathematical techniques for performing the required coordinate transformations are well known in the field of robotics. The axis positions are applied to well known motor drive equations 54. Each of the motor drive equations combines the associated desired axis position with the associated feedback position from motor feedback 56 and derives a drive 55 to be output to the respective motors 38–40 via the respective motor drivers 35–37.

For completeness, the equations utilized are as follows:

Gimbal Pitch $$\tan(G_P)=[\tan(R)\sin(G_A)/\cos(P)]-\tan(P)\cos(G_A)$$

Gimbal Twist $$\tan(G_T)=[\cos(R)\sin(P)\sin(G_A)-\sin(R)\cos(G_A)]/\text{DENOMINATOR}$$

where $$\text{DENOMINATOR}=[\sin^2(R)\sin^2(G_A)-2\sin(R)\sin(G_A)\cos(R)\sin(P)\cos(G_A)+\cos^2(R)\sin^2(P)\cos^2(G_A)+\cos^2(R)\cos^2(P)]^{\frac{1}{2}}$$

where:

R = aircraft roll angle

P = aircraft pitch angle $G_A$ = pedestal gimbal azimuth angle $G_P$ = pedestal gimbal pitch angle $G_T$ = pedestal gimbal twist angle.

For a given roll (R) and pitch (P) rotation of the aircraft, the resulting gimbal angles $G_T$ and $G_P$ required to maintain the antenna line of sight level for any given gimbal azimuth position $G_A$ are provided by the above equations. Given R, P and $G_A$, the pedestal gimbal pitch ($G_P$) and pedestal gimbal twist ($G_T$) are calculated. For a fixed turn (R and P fixed), a rotating (changing) azimuth axis $G_A$ requires changing gimbal axes $G_P$ and $G_T$ for stabilization.

With continued reference to FIG. 2, it is appreciated that with the arrangement of the present invention all of the axes of rotation a point on the center line of the antenna thus minimizing the swept volume thereof. It is furthermore appreciated, that if a fourth degree of freedom is required, such as elevation, an elevation control signal may be factored into the coordinate transformations to effect appropriate control in a manner similar to that described above with respect to azimuth rotation generation. An additional gimbal set would not be required as in the prior art.

The herein described embodiment of the present invention utilizes three axes of alignment, so that line of sight stabilization is achieved by rotation of these axes. The present invention replaces the traditional pedestal concept involving a mechanically stabilized platform similar to the configuration illustrated in FIG. 1. The pedestal of the present invention rotates in accordance with the diagram illustrated in FIG. 2. The antenna pedestal of the present invention, utilizing the computer controlled gimbal stabilization technique described above, is a design effectively utilized to optimize swept volume of the antenna and to optimize reliability. Each axis (gimbal azimuth, gimbal pitch, and gimbal twist as illustrated in FIG. 2) is driven by a motor assembly comprising a bearing pair, motor, and an optical encoder for position feedback. These motor units attach directly to the associated respective gimbals, resulting in a one-to-one rotation about the respective axes, thus eliminating the requirement for gearing. When utilizing brushless motors, the bearings and seals remain the only wearing mechanical parts. Assembly and repair time are reduced because the drive units can be pre-assembled and then installed onto their respective gimbals.

With continued reference to FIGS. 3 and 4, the control system of the present invention comprises the stabilization reference 30, the controller 34, the three motor drivers 35–37 and the three motor/optical encoder assemblies 38–43. The data from the stabilization reference (aircraft roll and aircraft pitch) is input to the controller 34. The control algorithm combines the roll and pitch with the data from the rotation generator 52 to derive the position of the antenna 10 on the simulated stabilized platform. The roll, pitch and antenna rotation positions are input to the set of coordinate transformation equations 53 that were derived from the order of the axes utilizing techniques known from robotics. The output of the coordinate transformation comprises three positions for the new gimbal axes. These desired gimbal positions are combined with the gimbal feedback from the optical encoders in a control algorithm derived utilizing techniques that are well known in the field of feedback control system design.

The result of the operation of the apparatus of FIGS. 2, 3 and 4, is that the radar antenna 10 mounted on the pedestal is positioned such that the line of sight and the orientation of the antenna is the same as if it had been attached to a traditional stabilized platform.

The present invention utilizes a gimbal system having an arbitrary order of precession of the gimbals. A computer is utilized to correct the line of sight using coordinate transformation equations. The new gimbal set utilizes as many degrees of freedom as is necessary to point the line of sight in any direction that a conventionally arranged gimbal set could provide. Typically, three degrees of freedom are utilized. A computer, as discussed above, is used to evaluate the set of coordinate transformation equations to convert from the axes utilized by the stabilization gyro to the new axes utilized by the gimbals. The computer then directs the gimbal axes to move to positions such that the line of sight of the antenna (or other device) points in the direction that would have been achieved utilizing the gimbal precession order of the stabilization gyro. Thus, a stabilized platform is created within the computer. The invention eliminates the requirement for a separate mechanically stabilized platform, since the axes that provide the stabilization are the same axes that provide the pointing. The number of required gimbals is minimized and no mechanical linkages other than the gimbals described above, are required.

The present invention is the application of computer control and techniques from robotics to provide the effect of a mechanically stabilized platform without the requirement of aligning the control axes in the same manner as a mechanically stabilized platform. The stabilized platform exists as equations within the control computer. Thus, the requirement to actually provide the conventional mechanically stabilized platform is eliminated.

While the invention has been described in its preferred embodiment, it is to be understood that the words which have been used are words of description rather than limitation and that changes may be made within the purview of the appended claims without departing from the true scope and spirit of the invention in its broader aspects.

We claim:

1. A stabilization system, for mounting on a moving vehicle having vehicle reference axes, for stabilizing a pointing device, having center line, to point in controlled direction with respect to inertial reference axes irrespective of motions of said vehicle with respect to said inertial axes, said controlled direction being controlled by a pointing signal, said system being responsive to a stabilization data reference providing stabilization signals in accordance with said motions of said vehicle about said reference axes, said stabilization signals being referenced to said vehicle reference, said system comprising a set of three gimbals interposed between said vehicle and said pointing device, said set of three gimbals having three gimbal axes and three gimbal drives one axis and one gimbal drive for each gimbal, said three gimbals constructed and arranged to rotate about said three gimbal axes, respectively, and coordinate transformation means responsive to said stabilization signals and said pointing signal for performing a coordinate transformation on said stabilization signals and said pointing signal by converting said stabilization signals from said vehicle reference axes to said gimbal axes and combining said pointing signal therewith to provide respective gimbal drive signals in accordance therewith, so that said gimbal drive signals applied to said gimbal drives, respectively, rotate said gimbals of said set of three gimbals about said gimbal axes, respectively, so as to maintain said pointing device pointing in said controlled direction.

2. The system of claim 1 wherein said stabilization data reference comprises a stabilization gyro.

3. The system of claim 2 wherein said gyro has two degrees of freedom.

4. The system of claim 1 wherein said pointing device comprises a radar antenna.

5. The system of claim 1 wherein said pointing device comprises a camera.

6. The system of claim 1 wherein said pointing device comprises an optical sight.

7. The system of claim 1 wherein said vehicle reference axes comprise roll and pitch axes of said vehicle, respectively.

8. The system of claim 7 wherein said vehicle comprises an aircraft.

9. The system of claim 1 wherein said stabilization data reference has two degrees of freedom.

10. The system of claim 1 wherein said vehicle reference axes comprise vehicle roll and pitch axes, said pointing signal comprises a desired azimuth angle signal and said gimbal axes comprise a gimbal pitch axis, a gimbal twist axis and a gimbal azimuth axis and wherein said coordinate transformation means provides said gimbal drive signals in accordance with:

Gimbal Pitch $$\tan(G_P)=[\tan(R)\sin(G_A)/\cos(P)]-\tan(P)\cos(G_A)$$

Gimbal Twist $$\tan(G_T)=[\cos(R)\sin(P)\sin(G_A)-\sin(R)\cos(G_A)]/\text{DENOMINATOR}$$

where $$\text{DENOMINATOR}=[\sin^2(R)\sin^2(G_A)-2\sin(R)\sin(G_A)\cos(R)\sin(P)\cos(G_A)+\cos^2(R)\sin^2(P)\cos^2(G_A)+\cos^2(R)\cos^2(P)]^{\frac{1}{2}}$$

where:

R = vehicle roll angle

P = vehicle pitch angle $G_A$ = pedestal gimbal azimuth angle $G_P$ = pedestal gimbal pitch angle $G_T$ = pedestal gimbal twist angle.

11. The system of claim 7 wherein said vehicle has a Z axes orthogonal to said roll and pitch axes, and said stabilization data reference has two degree of freedom.

12. The system of claim 11 wherein said set of three gimbals comprises a first gimbal mounted on said vehicle for rotation about said z axis, said z axis comprising a first gimbal, a second gimbal mounted on said first gimbal for rotation about a second gimbal axis orthogonal to said first axis, and a third gimbal mounted on said second gimbal for rotation about a third gimbal axis orthogonal to first and second gimbal axes, said pointing device being mounted on said third gimbal with said center line parallel to said third axis and remaining parallel to said third axis throughout all gimbal rotations.

13. The system of claim 12 wherein said vehicle comprises an aircraft and said pointing device comprises a radar antenna.

14. The system of claim 13 wherein said first gimbal points said radar antenna along said controlled direction and said third gimbal rotates said radar antenna to have appropriate polarization relative to said internal reference axes.

15. The system of claim 1 wherein said coordinate transformation means comprises computer means programmed to perform said coordinate transformation on said stabilization signals and said pointing signal to generate said gimbal drive signals.

16. The system of claim 1 wherein said coordinate transformation means is operative to perform said coordinate transformation on said stabilization signals and said pointing signal so that said gimbal drive signals maintain said pointing device at a predetermined orientation with respect to said inertial reference axes.

17. The system of claim 12 wherein said third gimbal axis is coincident with said center line and said three gimbals are constructed and arranged such that said three gimbal axes coverage at a point on said center line.

* * * * *